United States Patent [19]

Dale

[11] 4,347,273

[45] Aug. 31, 1982

[54] PILE CARPET TILE WITH CUT AND LOOP PILE

[75] Inventor: Robert V. Dale, North Babylon, N.Y.

[73] Assignee: Fieldcrest Mills, Inc., Eden, N.C.

[21] Appl. No.: 267,544

[22] Filed: May 27, 1981

[51] Int. Cl.[3] ..... B32B 3/00

[52] U.S. Cl. ..... 428/44; 428/62; 428/82; 428/88; 428/89; 428/92

[58] Field of Search ..... 428/62, 82, 88, 89, 428/92, 44

[56] References Cited

FOREIGN PATENT DOCUMENTS 51-19509 6/1976 Japan ..... 428/88

*Primary Examiner*—Marion McCamish

*Attorney, Agent, or Firm*—Bell, Seltzer, Park & Gibson

[57] ABSTRACT

A textile pile carpet tile having a pile body predominantly of loop pile extending from one end to the opposing end of the tile and a pair of opposing side marginal areas of predominantly cut pile extending along opposite sides of the pile body from said one end to the opposing end of the tile, and of an appearance contrasting with that of the pile body. Carpet tiles thusly constructed may be abuttingly positioned for forming patterned carpet surfaces with the carpet tiles arranged in lengthwise and widthwise rows with the pair of side marginal areas of alternate tiles in each row extending in the lengthwise direction, and with the pair of side marginal areas of intervening tiles extending in the widthwise direction so that the thus arranged carpet tiles form the desired pattern effect and enable the side marginal areas of the tiles formed of predominantly cut pile to shield from prominence any non-linearity in the ends of the carpet tiles defined predominantly of loop pile which would otherwise present an unsightly appearance.

6 Claims, 5 Drawing Figures

PILE CARPET TILE WITH CUT AND LOOP PILE

This invention relates to carpet tile and more particularly to pile carpet formed in relatively small squares processed to be readily used in the manner of tile.

The pile carpet tiles of this invention are constructed to have cut pile or predominantly cut pile marginal areas extending along opposite sides of a pile body formed of loop pile or predominantly of loop pile. With this arrangement of the different types of pile areas, very pleasing pattern effects may be obtained. Furthermore, it has been determined that the predominantly cut pile areas forming the side marginal areas of the tiles serve a masking function with reference to the ends of the tile which are defined by the body portion formed predominantly of loop pile.

More particularly, it has long been recognized that it is extremely difficult if not impossible in the forming of pile carpet tiles to cut the pile carpet with absolute lengthwise and widthwise linearity, that is, without cutting across rows of the pile. The slightest non-linearity of the cut line will result in the die or knife, whichever method is used to cut tiles, cutting through some or all pile loops thus leaving an unsightly line of pile tufts along the edge of the tile. By arranging the pile carpet tiles of this invention so that the side marginal areas of predominantly cut pile abut against loop pile edge portions of other like tiles, this results in the cut pile of the side marginal areas shielding from prominence any non-linearity or raggedness in the ends of the carpet tiles formed by the loop pile body areas that would otherwise present an unsightly appearance in the carpet surface.

Some of the features and advantages of this invention having been stated, others will appear as the description proceeds when taken in connection with the accompanying drawings, in which FIG. 1 is a schematic perspective view illustrating the manner in which pile carpet tiles of this invention may readily be cut from wide rolls of carpet for obvious economic reasons;

Figure 2:
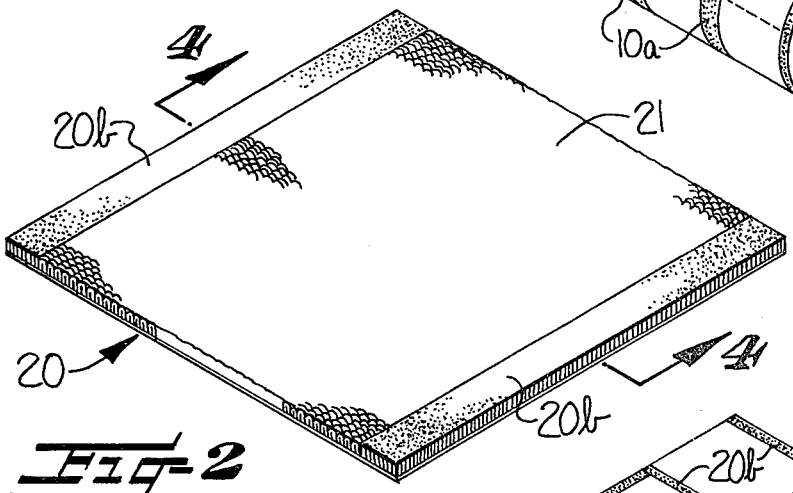
FIG. 2 is a schematic perspective view of a pile carpet tile of this invention.
Figure 4:
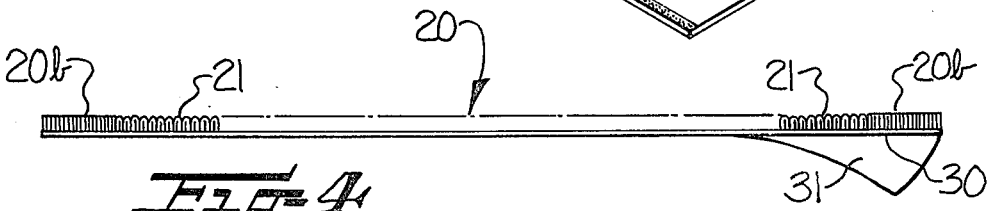
Figure 5:
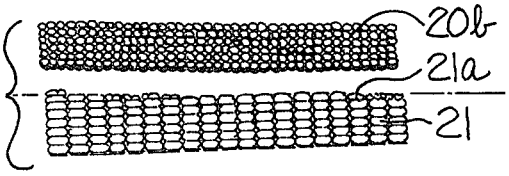

FIG. 4 is a cross-sectional view taken along the lines 4—4 of FIG. 2 with the peelable backing material being partially removed to expose the pressure sensitive adhesive on the backside of the carpet tile; and FIG. 5 is a schematic view to highlight the manner in which the cut pile side marginal areas of the tile shield and mask from prominence the non-linearity in the end of the carpet tile formed by the loop pile body areas.

Figure 1:
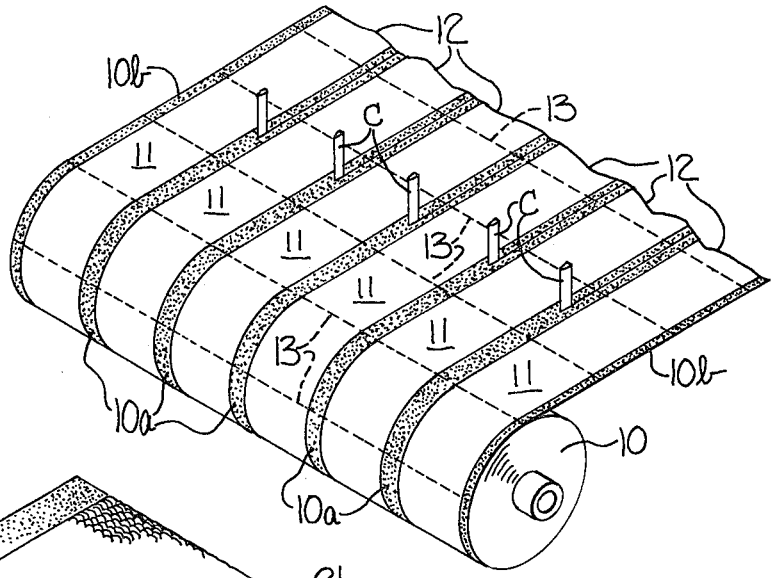

Referring now more particularly to the drawings, FIG. 1 illustrates a wide width of pile carpet formed by weaving, tufting, adhesive bonding or any other suitable process. Typically the pile carpet is formed of a twelve-foot width and thereafter formed into a roll of carpet 10 shown as being unrolled and passed by a plurality of knives C which serve for slitting the roll of carpet 10 into strips of predetermined widths. As illustrated, it will be noted that the strips, identified as 12, are six in number with each of the strips thus being two feet wide. As illustrated, the twelve-foot width roll of pile carpet 10 is constructed in such a manner that longitudinally extending predominantly cut pile areas 10*a*, each four inches wide, are provided across the width of the fabric with such cut pile areas being spaced about twenty inches apart with predominantly loop pile areas 11 therebetween. It will be noted that the knives C are arranged to cut along the medial or central area of these cut pile areas 10*a* to thus provide two inches of cut pile on opposite sides of each of the longitudinal strips 12 of carpet being cut from the twelve-foot wide roll. Further, it will be noted that the selvage or marginal side areas 10*b* of the twelve-foot wide roll are also provided with predominantly cut pile areas but of only half the width of the areas 10*a*, namely, two inches in width. The transversely extending dotted lines in FIG. 1 represent transverse cut lines 13 that will subsequently divide each of the strips 12 of carpet into two-foot square tiles 20, by these transverse cut lines 13 being spaced apart two feet from each other.

It will be noted in FIG. 2 that the carpet tile, broadly indicated by reference numeral 20, has cut pile or predominantly cut pile side marginal areas 20*b* extending from one end to the opposing end of the tile 20 and defining opposing sides of the tile and wherein the body 21 of the tile between such side marginal areas 20*b* is formed of loop pile or predominantly loop pile. As illustrated, the loop pile extends from one end to the opposing end of the tile.

For purposes of this invention the terms "predominantly cut pile" and "predominantly loop pile" are used to indicate that the cut pile side marginal areas 20*b* may include some loop pile and that the loop pile body 21 therebetween may include some cut pile. The important consideration is that the benefits of this invention still be present therein.

As is typically the case of carpet tiles, the back side of the carpet tile 20 is provided with pressure sensitive adhesive 30 (FIG. 4) with a covering of thin paper or paper-like sheet material 31 applied over the pressure sensitive adhesive and which may be readily peeled from the same to expose the adhesive for direct application of the carpet tile to a selected floor, wall or the like.

Figure 3:
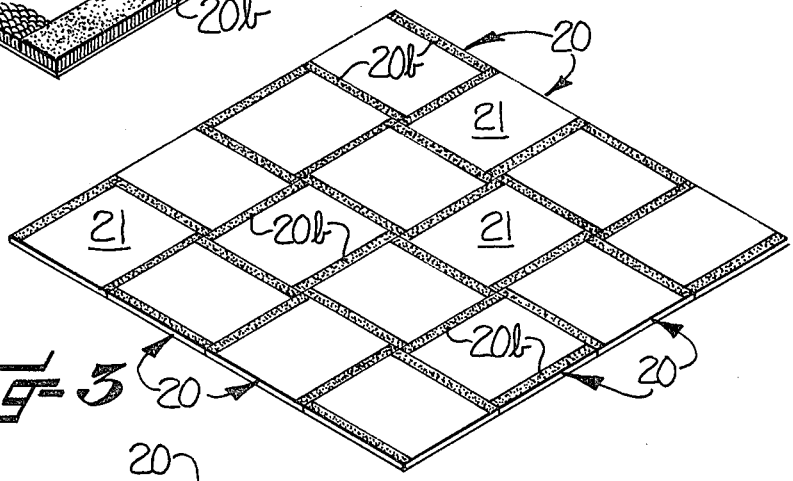
FIG. 3 is a schematic perspective view illustrating a desirable pattern arrangement of the pile carpet tiles of this invention.

Referring now to FIG. 3, it will be noted that the carpet tiles 20 of this invention have been arranged in a predetermined desirable pattern arrangement for presenting a very pleasing and aesthetic effect. This effect may be characterized as presenting the predominantly cut pile areas of the tile in a staggered arrangement both longitudinally, and transversely throughout the carpet surface. More particularly, it will be noted that the carpet tiles 20 have been arranged in a pattern wherein the carpet tiles are arranged in lengthwise and widthwise abutting rows with the pair of side marginal areas 20*b* of alternate tiles in each row extending in the lengthwise direction and with the pair of side marginal areas of intervening tiles in each row extending in the widthwise direction so that the arrangement of the carpet tiles forms the desired pattern effect.

Also, of utmost importance of this invention is the fact that the predominantly cut pile side marginal areas of each of the tiles serve to shield from prominence any non-linearity in the ends of the carpet tiles formed by the predominantly loop pile areas 21 that would otherwise present an unsightly appearance. In this regard, attention is directed to FIG. 5 wherein is schematically illustrated a non-linear cut along the edge of the tile defined by the predominantly loop pile body 21 and which edge is identified at 21*a*. Upon observing this edge 21*a* as illustrated, it will be noted that the cut line did not desirably fall in the linear direction so as to avoid cutting through and across the loop pile rows, with the result that the edge 21*a* of the loop pile body 21 is of an unpleasing somewhat ragged unsightly line effect. By abuttingly positioning the predominantly cut pile areas 20*b* defining the side marginal areas of the carpet tile immediately against such unsightly non-linear cut lines, the unsightly nature of the same is masked or shielded from prominence to thus avoid what would otherwise be an unsightly appearance. Further, as best illustrated in FIG. 4, it will be noted that the side marginal areas 20*b* of predominantly cut pile are of greater height than the loop pile in the pile body 21. This further contributes to the masking and shielding effect of the cut pile areas to the non-linear loop pile side areas of the tiles.

It will thus be seen wherein, by the teachings of this invention, not only may very pleasing pattern effects be formed of the pile carpet tiles, but any non-linearity in side edges of the carpet tiles defined predominantly by loop pile areas, may be masked from presenting an unsightly appearance by the shielding effect presented thereto by the abutting arrangement of the predominantly cut pile side marginal areas of the tile thereagainst.

In the drawings and specification, there has been set forth a preferred embodiment of the invention and although specific terms are employed, they are used in a generic and descriptive sense only and not for purposes of limitation.

That which is claimed is:

1. A pile carpet tile of square configuration having a pile body of loop pile extending from one end to the opposing end of the tile, and a pair of opposing side marginal areas of cut pile extending along opposite sides of said loop pile body from said one end to said opposing end of the tile, and wherein the cut pile is of greater height than the loop pile body and presents an appearance contrasting with that of said loop pile body.

2. A carpet surface formed from a plurality of textile pile carpet tiles of square configuration arranged in abutting relation and each having a pile body predominantly of loop pile extending from one end to the opposing end of the tile, and a pair of opposing side marginal areas of predominantly cut pile extending along opposite sides of said pile body from said one end to said opposing end of the tile and of an appearance contrasting with that of said body, said carpet tiles being arranged in lengthwise and widthwise abutting rows with said pair of side marginal areas of alternate tiles in each row extending in the lengthwise direction, and with said pair of side marginal areas of intervening tiles in each row extending in the widthwise direction so that the arrangement of the carpet tiles forms the desired pattern effect and enables the marginal side areas of the tiles formed of predominantly cut pile to shield from prominence any non-linearity in the ends of the carpet tiles that would otherwise present an unsightly appearance.

3. A carpet surface according to claim 1 wherein said cut pile in said side marginal areas is of greater height than the loop pile in said pile body.

4. A carpet surface according to claim 2 wherein each carpet tile is about two feet square, and wherein said pile body has a width substantially over one half the width of the overall tile.

5. A carpet surface formed from a plurality of textile pile carpet tiles of square configuration arranged in abutting relation and each having a pile body predominantly of loop pile extending from one end to the opposing end of the tile, and having a width substantially over one half the width of the overall tile, and a pair of opposing side marginal areas of predominantly cut pile extending along opposite sides of said pile body from said one end to said opposing end of the tile and of an appearance contrasting with that of said body, each of said side marginal areas being of substantially the same width as each other and of a width of no more than about one tenth the width of the overall tile, said carpet tiles being arranged in lengthwise and widthwise abutting rows with said pair of side marginal areas of alternate tiles in each row extending in the lengthwise direction, and with said pair of side marginal areas of intervening tiles in each row extending in the widthwise direction, so that the arrangement of the carpet tiles forms the desired pattern effect and enables the marginal side areas of the tiles formed of predominantly cut pile to shield from prominence any non-linearity in the ends of the carpet tiles that would otherwise present an unsightly appearance.

6. A carpet surface according to claim 5 wherein said cut pile in said side marginal areas is of greater height than the loop pile in said pile body.

* * * * *

UNITED STATES PATENT AND TRADEMARK OFFICE

CERTIFICATE OF CORRECTION

PATENT NO. : 4,347,273

DATED : August 31, 1982

INVENTOR(S) : Robert V. Dale

It is certified that error appears in the above-identified patent and that said Letters Patent are hereby corrected as shown below:

Column 2, line 57, "of" (second occurrence) should be --to--.

Claim 3 - Column 4, line 12, "claim 1" should be --claim 2--.

Signed and Sealed this

*Fifteenth* Day of *March 1983*

[SEAL]

*Attest:*

GERALD J. MOSSINGHOFF

*Commissioner of Patents and Trademarks*

*Attesting Officer*